US007001037B1

(12) United States Patent
Shiao

(10) Patent No.: US 7,001,037 B1
(45) Date of Patent: Feb. 21, 2006

(54) LIGHTING DEVICE WITH ACCESSORY UNIT

(76) Inventor: Hsuan-Sen Shiao, No. 55, Cheng-Feng Lane, Tai-Ming Rd., Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 11/011,019

(22) Filed: Dec. 9, 2004

(51) Int. Cl.
*F21V 33/00* (2006.01)

(52) U.S. Cl. ..... 362/109; 362/119; 362/138

(58) Field of Classification Search ..... 362/119, 362/135, 138, 139, 398, 109, 198; 294/65.5
See application file for complete search history.

(56) References Cited

U.S. PATENT DOCUMENTS 1,909,662 A * 5/1933 Conners ..... 362/109
5,381,319 A 1/1995 Shiao ..... 362/120
5,428,484 A * 6/1995 Baker ..... 362/139
6,193,386 B1 * 2/2001 Reynolds ..... 362/119

* cited by examiner

*Primary Examiner*—Y. My Quach-Lee
(74) *Attorney, Agent, or Firm*—Ladas & Parry LLP

(57) ABSTRACT

A lighting device includes a handheld unit, a light bulb, and an accessory unit. The handheld unit defines a battery compartment, and includes a screw hole formed in one end of the handheld unit. The light bulb engages threadedly the screw hole. The accessory unit includes a positioning member attached to the end of the handheld unit, an arm extending outwardly from the positioning member and inclining with respect to an axis of the screw hole, and an accessory member connected to the arm and offset from the light bulb. The handheld unit further includes an external screw thread formed on an outer surface of the one end of the handheld unit. The positioning member includes a ring member engaged threadedly to the external screw thread and connected to the arm.

9 Claims, 8 Drawing Sheets

LIGHTING DEVICE WITH ACCESSORY UNIT

BACKGROUND OF THE INVENTION

1. Field of the Invention

The invention relates to a lighting device, more particularly to a lighting device with an accessory unit.

2. Description of the Related Art

Referring to FIG. 1, a conventional telescopic magnetic retriever with illuminating means, as disclosed in U.S. Pat. No. 5,381,319, includes a handheld unit 1 extending along an axial line (L1), a telescopic shaft 2 disposed in the handheld unit 1 and extending along the axial line (L1), a lamp unit 3 opposite to the handheld unit 1 along the axial line (L1) and mounted on top of the telescopic shaft 2, and a magnet 4 mounted axially on the lamp unit 3.

Although the conventional telescopic magnetic retriever can achieve its intended purpose, because the magnet 4 and the lamp holder 3 are located along the axial line (L1), the magnet 4 can block a portion of the light emitted by the lamp unit 3 such that the illuminating effect of the conventional telescopic magnetic retriever during use is adversely affected.

SUMMARY OF THE INVENTION

Therefore, the object of the present invention is to provide a lighting device with an accessory unit that is capable of overcoming the aforementioned drawback of the prior art.

According to this invention, a lighting device comprises a handheld unit, a light bulb, and an accessory unit. The handheld unit defines a battery compartment, and includes a screw hole formed in one end of the handheld unit. The light bulb engages threadedly the screw hole. The accessory unit includes a positioning member attached to said one end of the handheld unit, an arm extending outwardly from the positioning member and inclining with respect to an axis of the screw hole, and an accessory member connected to the arm and offset from the light bulb. The handheld unit further includes an external screw thread formed on an outer surface of the one end of the handheld unit. The positioning member includes a ring member engaged threadedly to the external screw thread and connected to the arm.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
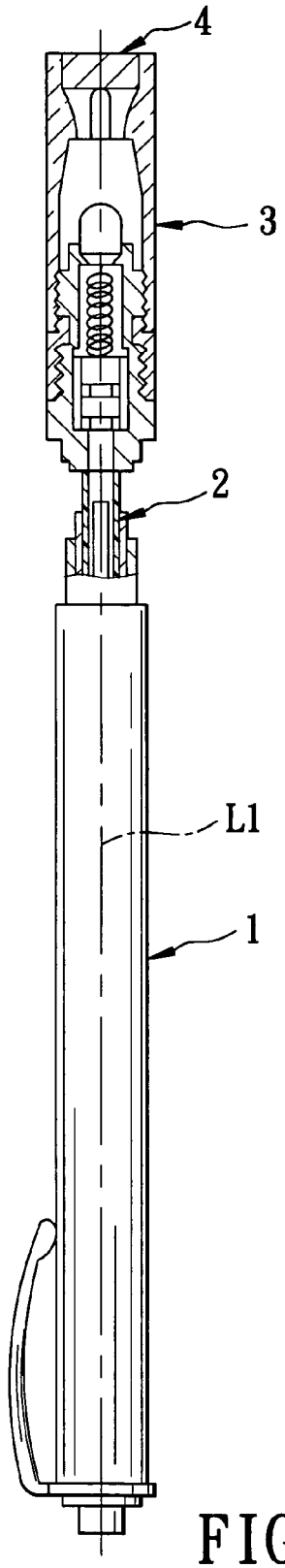
FIG. 1 PRIOR ART
FIG. 1 illustrates a conventional telescopic magnetic retriever with illuminating means according to U.S. Pat. No. 5,381,319.

Before the present invention is described in greater detail, it should be noted that like elements are denoted by the same reference numerals throughout the disclosure.

Figure 2:
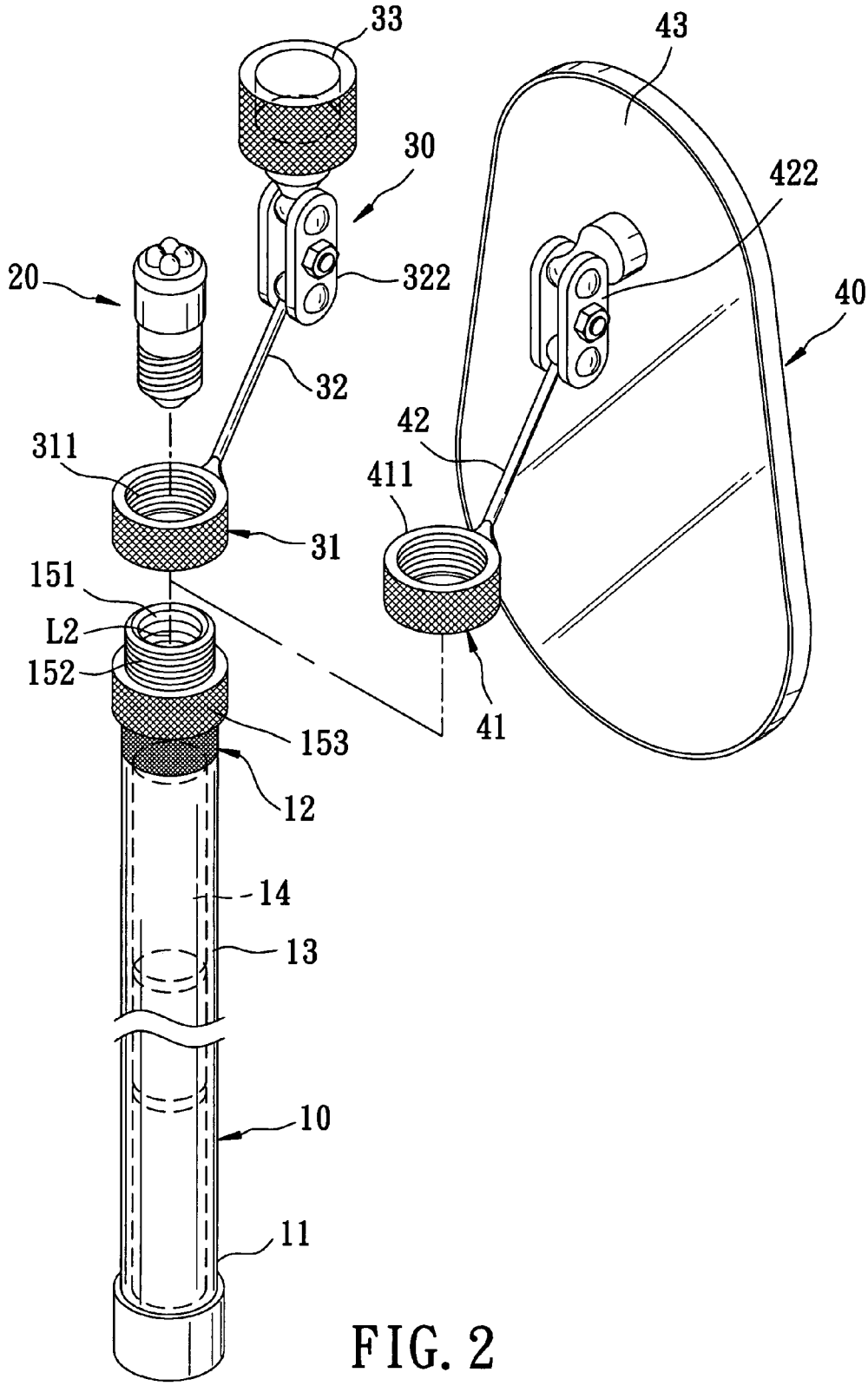
FIG. 2 is an exploded perspective view of the first preferred embodiment of a lighting device according to the present invention.
Figure 3:
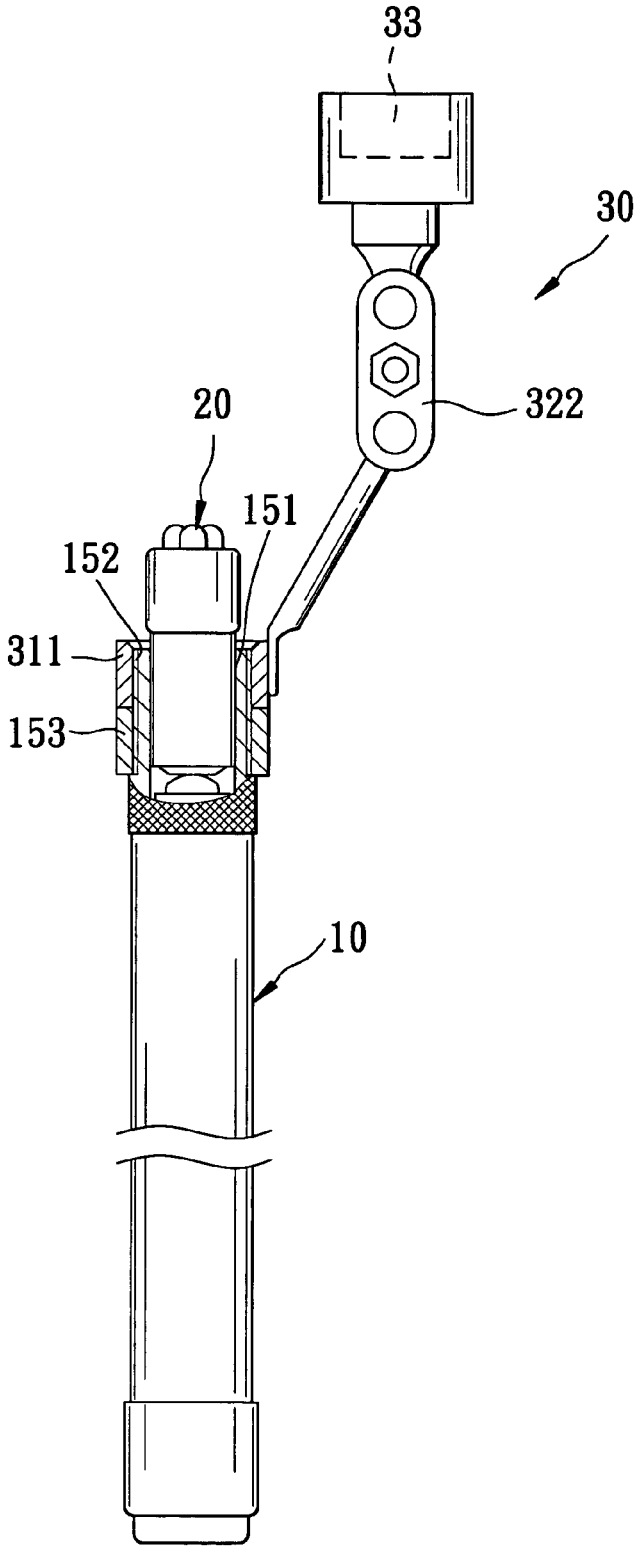
FIG. 3 is a partly sectional view of the first preferred embodiment in an assembled state, illustrating an interconnection between a handheld unit and a first accessory unit.
Figure 4:
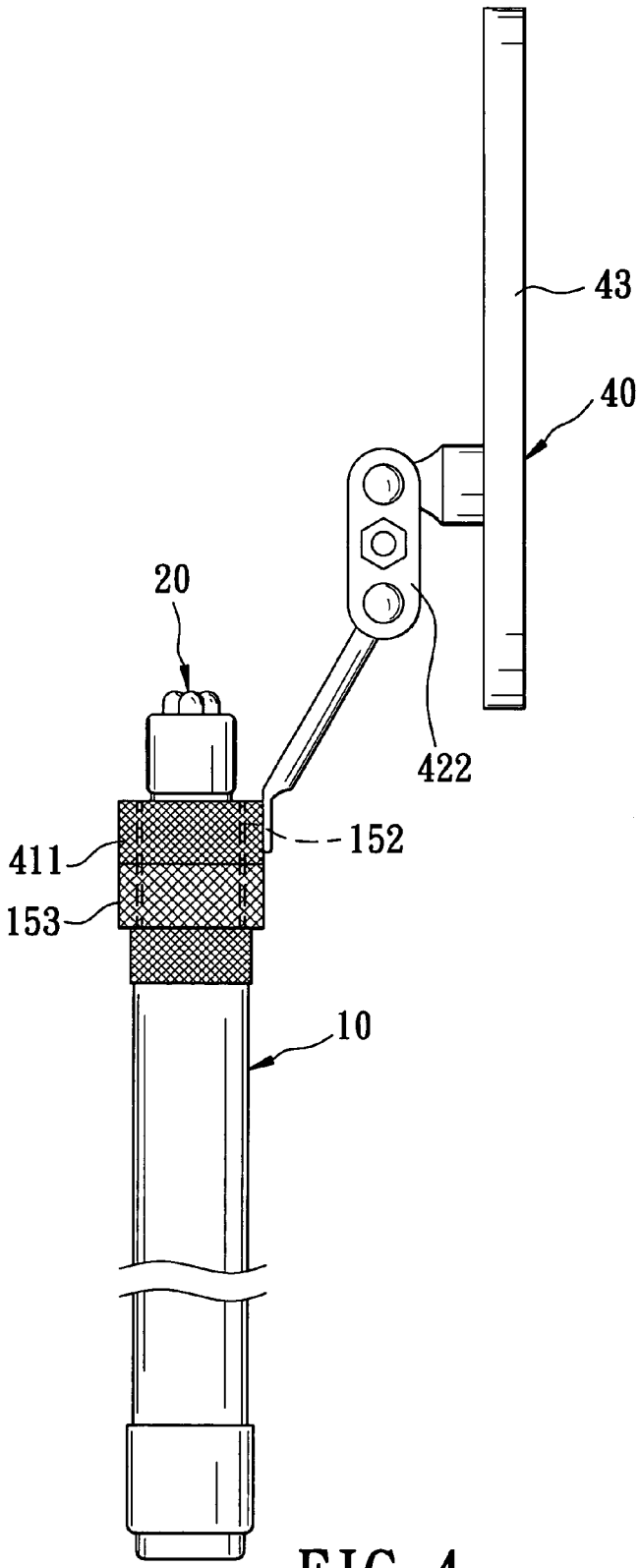
FIG. 4 is a view similar to FIG. 3, but illustrating an interconnection between the handheld unit and a second accessory unit.

Referring to FIGS. 2 to 4, the first preferred embodiment of a lighting device according to the present invention is shown to comprise a handheld unit 10, a light bulb 20, and first and second accessory units 30, 40.

The handheld unit 10 is elongated, defines a battery compartment for receiving a plurality of batteries 14 therein, and includes a first end 12 formed with a screw hole 151, a second end 11 opposite to the first end 12 along an axial line (L2), an intermediate portion 13 between the first and second ends 12, 11, and an external screw thread 152 formed on an outer surface of the first end 12.

The light bulb 20 engages threadedly the screw hole 151, and is operable to emit light rays upon establishing a closed electrical circuit with the batteries 14 in a conventional manner.

Each of the first and second accessory units 30, 40 includes a positioning member 31, 41 to be attached to the first end 12 of the handheld unit 10, an arm 32, 42 extending outwardly from the positioning member 31, 41 and inclining with respect to the axial line (L2), a pivot seat 322, 422 connected fixedly to the arm 32, 42, and an accessory member 33, 43 connected to the arm 32, 42 through the pivot seat 322, 422. The accessory members 33, 43 are offset from the light bulb 20 due to the inclined configuration of the arms 32, 42. The positioning member 31, 41 includes a ring member 311, 411 to engage threadedly the external screw thread 152, and a positioning nut 153 engaged to the external screw thread 152 for tightening the ring member 311, 411 on the external screw thread 152. The ring member 311, 411 is connected to the arm 32, 42. The accessory member 33 of the first accessory unit 30 includes a magnet, and is connected pivotally to the pivot seat 322. The accessory member 43 of the second accessory unit 40 includes a mirror, and is connected pivotally to the pivot seat 422.

With reference to FIG. 3, when a user desires to pick up an object (not shown), such as a screw, a spring, etc., that was dropped in a narrow and inaccessible place, a combination of the handheld unit 10 and the first accessory unit 30 is selected. To assemble this combination, the ring member 311 is engaged to the external screw thread 152, after which the positioning nut 153 is rotated so as to better secure the ring member 311. Therefore, the first accessory unit 30 is securely positioned on the handheld unit 10. Next, the light bulb 20 is engaged to the screw hole 151. Through the light rays emitted by the light bulb 20 and through the magnetic attractive force exhibited by the first accessory unit 30, the dropped object may be easily found and retrieved. The first accessory unit 30 can be adjusted to the desired angle and direction through the pivot seat 322.

With reference to FIG. 4, when the user desires to observe an area in a narrow place or on a bottom portion of a machine, a combination of the handheld unit 10 and the second accessory unit 40 is selected. To assemble this combination, the ring member 411 is engaged to the external screw thread 152, after which the positioning nut 153 is rotated so as to better secure the ring member 411. Therefore, the second accessory unit 40 is positioned on the handheld unit 10. Next, the light bulb 20 is engaged to the screw hole 151. Through the light rays emitted by the light bulb 20 and through the reflecting function of the second accessory unit 40, the area in the narrow place or on the bottom portion of the machine can be observed. The second accessory unit 40 can be adjusted to the desired angle and direction through the pivot seat 422.

Figure 5:
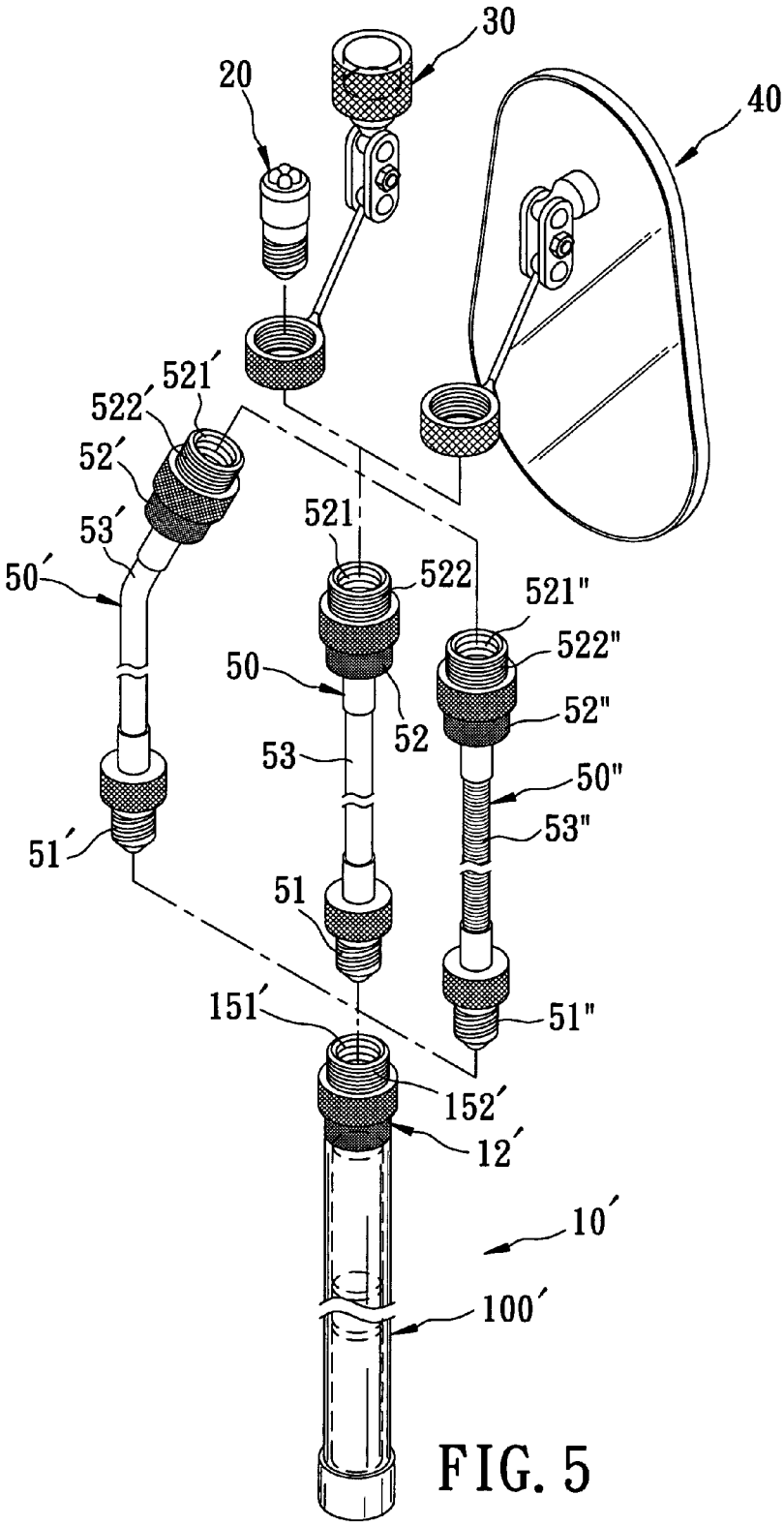
FIG. 5 is an exploded perspective view of the second preferred embodiment of a lighting device according to the present invention.
Figure 6:
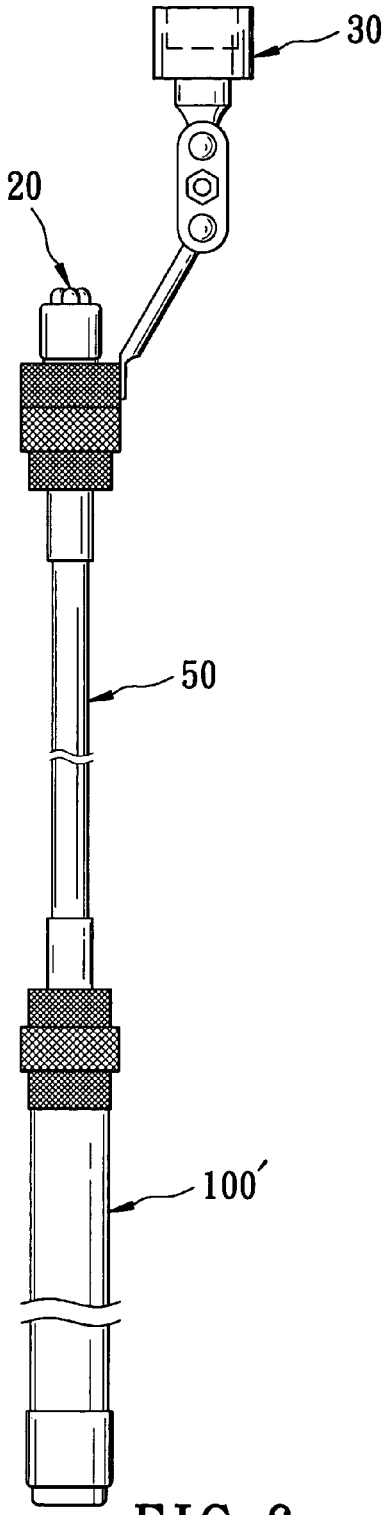
FIG. 6 is a schematic view of the second preferred embodiment in an assembled state, illustrating a connection among a handheld unit, an accessory member, and an extension member.

Referring to FIGS. 5 and 6, the second preferred embodiment of the lighting device according to the present invention is shown to be similar to the first preferred embodiment. However, in this embodiment, the handheld unit 10' includes a grip body 100', and a plurality of extension members. In this embodiment, three extension members 50, 50', 50" are exemplified. The grip body 100' has the screw hole 151' formed in the first end 12', and the external screw thread 152' formed on the outer surface of the first end 12'. Each of the first to third extension members 50, 50', 50" has a first end 52, 52', 52", a screw hole 521, 521', 521" formed in the first end 52, 52', 52", an external screw thread 522, 522', 522" formed on an outer surface of the first end 52, 52', 52", a second end 51, 51', 51" opposite to the first end 52, 52', 52", and an intermediate portion 53, 53', 53" between the first and second ends 52, 52', 52", 51, 51', 51". The second end 51, 51', 51" has an externally threaded section engaged to the screw hole 151' in the grip body 100'. The light bulb 20, in this embodiment, is connected to the screw hole 521, 521', 521" in one of the first to third extension members 50, 50', 50".

The intermediate portion 53 of the first extension member 50 is straight, while that of the second extension member 50' is curved. The intermediate portion 53" of the third extension member 50" is flexible.

With reference to FIG. 6, when the first extension member 50 is connected to the grip body 100', and when used in conjunction with the light bulb 20 and the desired first or second accessory unit 30, 40 (use of the first accessory unit 30 is illustrated in FIG. 6), the lighting device of the present invention is prolonged, and the advantages of the first preferred embodiment are similarly achieved. Although FIG. 6 only illustrates the interconnection between the first extension member 50 and the grip body 100', the grip body 100' may be interconnected with the second or third extension member 50', 50" depending on the particular use requirements.

Figure 7:
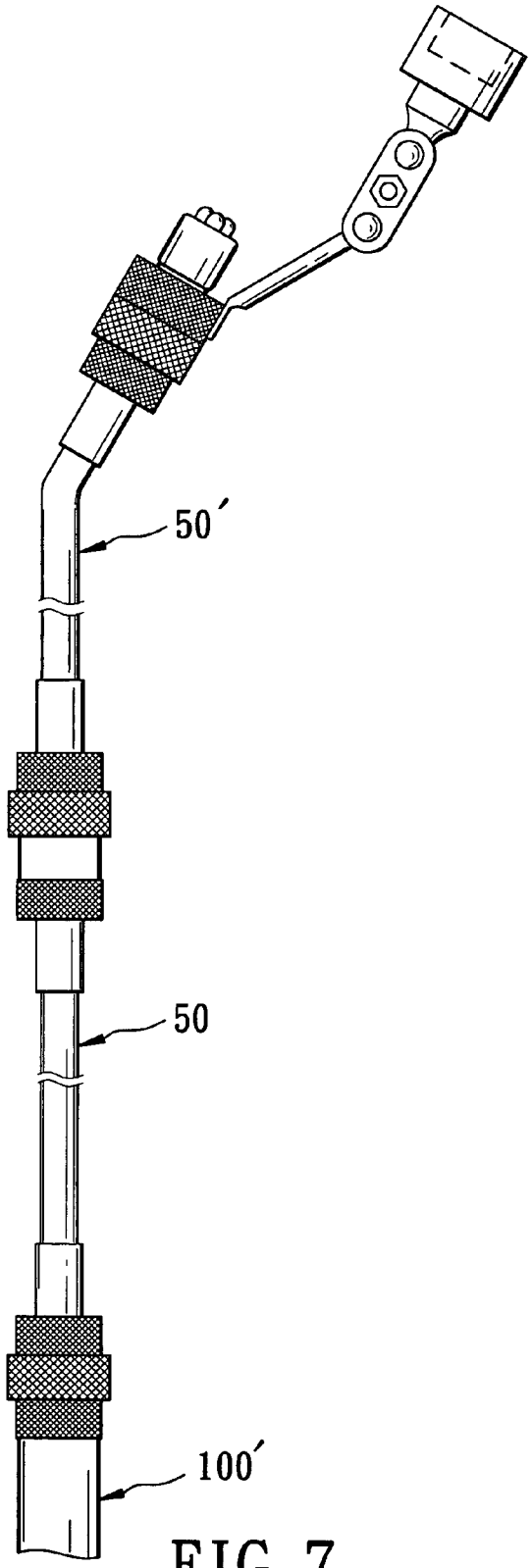
FIG. 7 illustrates an alternative form of the second preferred embodiment.
Figure 8:
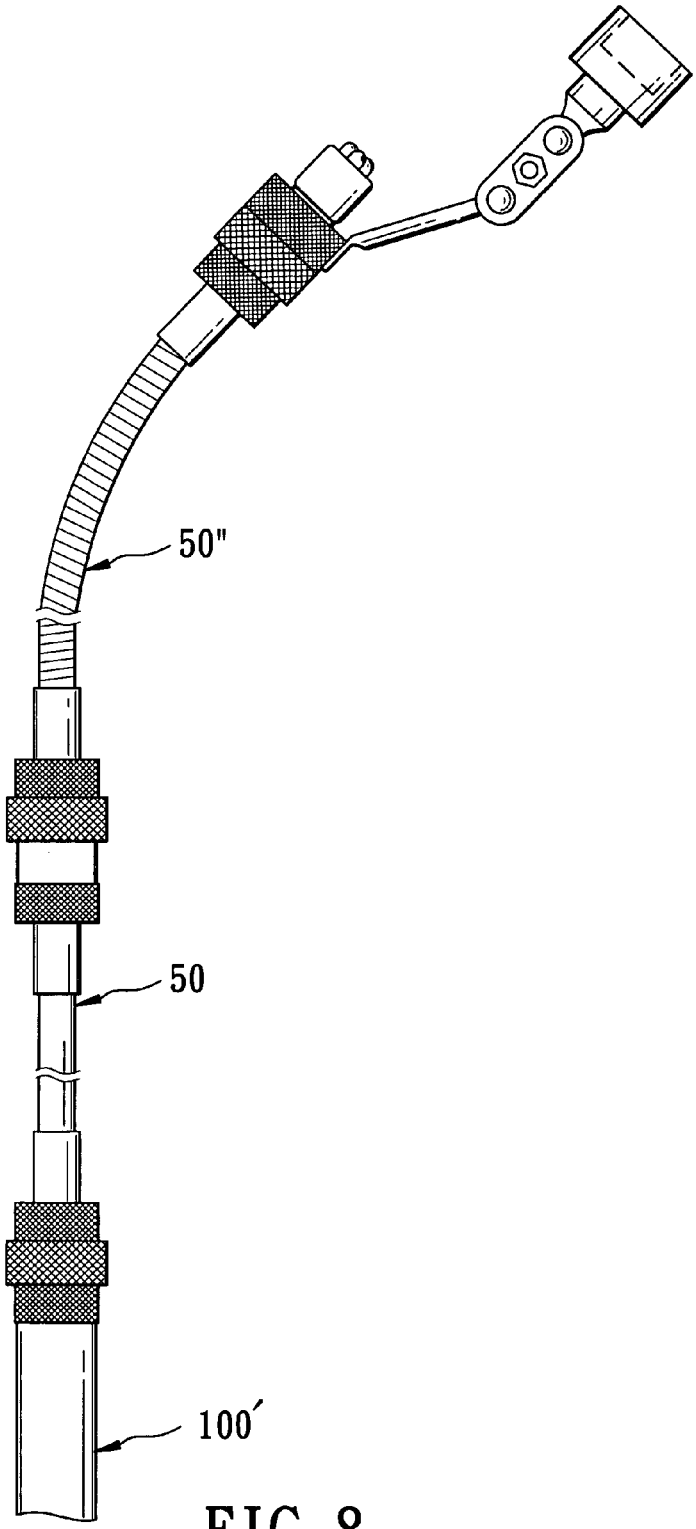
FIG. 8 is a view similar to FIG. 7, but illustrating another alternative form of the second preferred embodiment.

A combination of the first to third extension members 50, 50', 50" may be used. For example, the first and second extension members 50, 50' may be connected to the grip body 100', as shown in FIG. 7, or the first and third extension members 50, 50" may be connected to the grip body 100', as shown in FIG. 8, so as to further prolong the lighting device of the present invention. Further still, the grip body 100' may be connected with all of the first to third extension members 50, 50', 50" (not shown) in varying combinations.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A lighting device comprising:

a handheld unit defining a battery compartment, and including a screw hole formed in one end of said handheld unit;

a light bulb engaged threadedly to said screw hole; and an accessory unit including a positioning member attached to said one end of said handheld unit, an arm extending outwardly from said positioning member and inclining with respect to an axis of said screw hole, and an accessory member connected to said arm and offset from said light bulb, wherein said handheld unit further includes an external screw thread formed on an outer surface of said one end of said handheld unit, said positioning member including a ring member engaged threadedly to said external screw thread, said ring member being connected to said arm.

2. The lighting device as claimed in claim 1, wherein said positioning member further includes a positioning nut engaged to said external screw thread for tightening said ring member on said external screw thread.

3. The lighting device as claimed in claim 1, wherein said accessory member includes a magnet.

4. The lighting device as claimed in claim 1, wherein said accessory member includes a mirror.

5. The lighting device as claimed in claim 1, wherein said handheld unit includes a grip body and at least one extension member, each of said grip body and said extension member having a first end, said screw hole formed in said first end, and said external screw thread formed on an outer surface of said first end, said extension member further having a second end which has an externally threaded section engaged to said screw hole in said grip body, and an intermediate portion between said first and second ends, said first end of said extension member being said one end of said handheld unit, said light bulb being connected to said screw hole in said extension member, said accessory unit being connected to said external screw thread of said extension member.

6. The lighting device as claimed in claim 5, wherein said intermediate portion is straight.

7. The lighting device as claimed in claim 5, wherein said intermediate portion is curved.

8. The lighting device as claimed in claim 5, wherein said intermediate portion is flexible.

9. The lighting device as claimed in claim 5, wherein said handheld unit includes a plurality of said extension members connected to each other.

* * * * *